United States Patent [19]

Gerling

[11] 4,323,746

[45] Apr. 6, 1982

[54] MICROWAVE HEATING METHOD AND APPARATUS

[75] Inventor: John E. Gerling, Cupertino, Calif.

[73] Assignee: Jova Enterprises, Inc., Modesto, Calif.

[21] Appl. No.: 116,001

[22] Filed: Jan. 28, 1980

[51] Int. Cl.[3] ..... H05B 6/70

[52] U.S. Cl. ..... 219/10.55 F

[58] Field of Search ..... 219/10.55 F, 10.55 R, 219/10.55 A, 10.55 M

[56] References Cited

U.S. PATENT DOCUMENTS

| | | | |
|---|---|---|---|
| 2,790,054 | 4/1957 | Haagensen | 219/10.55 F |
| 2,909,635 | 10/1959 | Haagensen | 219/10.55 F |
| 3,806,689 | 4/1974 | Kegereis et al. | 219/10.55 F |

*Primary Examiner*—Arthur T. Grimley

*Attorney, Agent, or Firm*—Flehr, Hohbach, Test, Albritton & Herbert

[57] ABSTRACT

Microwave oven and method utilizing an oven cavity having two feed ports, one of which supplies microwave energy from the magnetron to the cavity. Energy reflected back into the first port is returned to the cavity through the second port.

5 Claims, 3 Drawing Figures

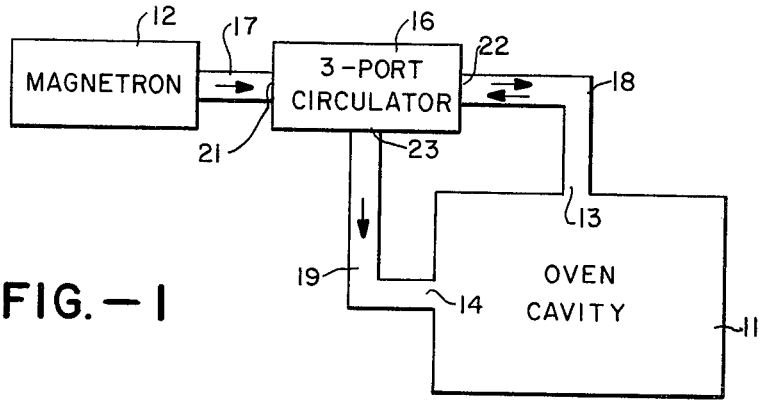
FIG.—1
| (1) LOAD | (2) POWER OUTPUT | (3) % FULL | (4) POWER LOST | (5) REFLECTED POWER | (6) REFLECTED POWER ABSORBED | (7) NET POWER TO LOAD | (8) IMPROVEMENT |
|---|---|---|---|---|---|---|---|
| 50 gm | 306 W. | 55.6% | 244 W. | 195.2 W. | 108.5 W. | 415 W. | 35.3% |
| 100 gm | 368 W. | 66.9% | 182 W. | 145.6 W. | 97.4 W. | 465 W. | 26.3% |
| 275 gm | 417 W. | 75.8% | 133 W. | 106.4 W. | 80.6 W. | 498 W. | 19.3% |
| 500 gm | 468 W. | 85.1% | 82 W. | 65.6 W. | 55.8 W. | 524 W. | 11.9% |
| 1000 gm | 482 W. | 87.6% | 68 W. | 54.4 W. | 47.6 W. | 530 W. | 9.9% |
| 2000 gm | 529 W. | 96.2% | 21 W. | 16.8 W. | 16.2 W. | 545 W. | 3.1% |
| MAX | 550 W. | 100 % | 0 | 0 | 0 | 550 W. | — |
FIG.—2
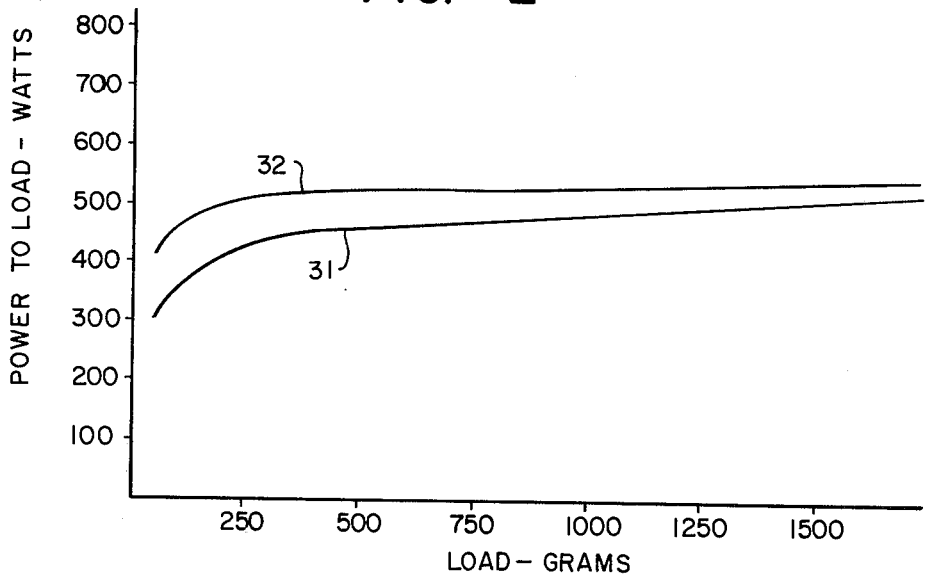
FIG.—3

MICROWAVE HEATING METHOD AND APPARATUS

This invention pertains generally to the heating of foods and other materials and more particularly to a microwave oven and method of using the same.

In a microwave oven, a portion of the energy supplied to the oven cavity is reflected back to the magnetron through the feed port. This reflected energy produces no heating of the material in the oven cavity, and it can damage or shorten the life of the magnetron, particularly under no-load conditions. While magnetrons can be constructed to withstand the reflected power, doing so generally reduces the operating efficiency of the magnetron.

It is in general an object of the invention to provide a new and improved method and apparatus for heating with microwave energy.

Another object of the invention is to provide a method and apparatus of the above character in which energy reflected back toward from the magnetron from the oven cavity is returned to the oven cavity.

These and other objects are accomplished in accordance with the invention by providing a microwave oven having two feed ports, one of which supplies energy from the magnetron to the oven cavity. Energy reflected back to the first port from the cavity is returned to the cavity through the second port where it is again available to produce useful heating. The method lies in the operation of the oven and comprises the steps of placing the material to be heated in the oven cavity, supplying microwave energy to the oven cavity through the first feed port, and feeding energy reflected from the cavity to the first port back to the cavity through the second port.

FIG. 1 is a schematic illustration of one embodiment of a microwave oven incorporating the invention.

FIG. 2 is a table illustrating the delivery of power to loads of different sizes in a microwave oven incorporating the invention.

FIG. 3 is a graphical representation of a portion of the data in FIG. 2, illustrating the relative amounts of power delivered to the load with and without the invention.

As illustrated in the drawing, the oven comprises a cavity 11 for receiving the material to be heated and magnetron 12 which is excited in a conventional manner to produce microwave energy of suitable frequency e.g. 2.45 GHz. Two feed ports 13, 14 open into the oven cavity for introducing microwave energy into the cavity. The magnetron and feed ports are interconnected by three-port circulator 16 and waveguide sections 17–19 whereby microwave energy is delivered from the magnetron to the oven cavity through feed port 13 and any energy reflected from the cavity back to that port is returned to the cavity through feed port 14. Waveguide section 17 extends between the magnetron and input port 21 of the three-port circulator, waveguide section 18 extends between circulator port 22 and feed port 13, and waveguide section 19 extends between circulator port 23 and feed port 14. The three-port circulator is of conventional design and provides unilateral transmission of microwave energy from input port 21 to port 22 and from port 22 to port 23.

In order to prevent microwave energy from passing directly between feed ports 13 and 14, the feed ports are isolated from each other in the oven cavity. This can be done in any suitable manner, for example, by using E-plane orientation for one port and H-plane orientation for the other, or by employing feed horns oriented by coupling with opposite senses, e.g. right hand circular polarization of energy from one port and left hand circular polarization of energy from the other.

Operation and use of the oven, and therein the method of the invention, is as follows. The material to be heated is placed in the oven cavity, and the magnetron is energized. Three-port circulator 16 delivers the energy from the magnetron to the oven cavity through feed port 13. Any portion of the energy which is reflected back from the cavity to feed port 13 is then directed back into the cavity by the three-port circulator through feed port 14.

As described in U.S. Pat. No. 4,009,359, Feb. 22, 1977, not all of the power in a microwave oven is delivered to the load. Some is lost in the cavity walls, rollers, mode stirrers and other elements within the cavity. Some is reflected back to the feed port, and some is consumed in end loads. In FIG. 2, it is assumed that 20% of the lost power is lost in the cavity and 80% is reflected back to the feed port. It is also assumed that the three port circulator provides 20 db isolation between its ports so that the feed ports are isolated by 20 db.

In FIG. 2, data is given for loads of 50 gm, 100 gm., 275 gm, 500 gm, 1,000 gm, and 2,000 gm of water containing 1% NaCl. The power output data is column 2 represents the amount of power absorbed by the different loads without the invention and was obtained by averaging the power outputs measured for seven ovens having different rated power outputs, cavity sizes and cavity materials. The power outputs were measured as described in Gerling, "Power Output Measurement in Microwave Ovens", MICROWAVE ENERGY APPLICATIONS NEWSLETTER, Vol. II, no. 3(1978), pp. 20–27. Column 3 indicates the power outputs as percentages of the maximum power output, and column 4 indicates the amount of power lost for each load. Column 5 indicates the amount of power reflected back to feed port 13 for each load, i.e. 80% of the amount in column 4, and column 6 indicates the amount of the reflected power which is absorbed by each load, i.e., col. 3×col. 5. Column 7 indicates the net power to the load, i.e. the sum of originally absorbed power (column 2) and the reflected power which is absorbed (column 6), and column 8 indicates the improvement in power delivered to the load.

In FIG. 3, curve 31 represents the power originally absorbed by the load (column 2), and curve 32 represents the total of the original and reflected power absorbed by the load (column 7).

From FIGS. 2 and 3, it can be seen that the invention provides a substantial increase in the power absorbed by the load to produce useful heating. This improvement is particularly significant with smaller loads, although it is also significant for larger loads. The Department of Energy calculates the average power output for a microwave oven by averaging the amount of power absorbed by loads of 275 gm, 500 gm, 1,000 gm and 2,000 gm. In the example of FIG. 2, the DOE rated power output would be 474 watts, which corresponds to a power input of 1,185 watts, with an oven efficiency of 40%. With the additional absorption of reflected energy, the average power output for the 275 gm, 500 gm, 1,000 gm and 2,000 gm loads is 524 watts. Thus, with the reflected energy being fed back to the cavity, the oven efficiency is 524 watts/1185 watts, or 44.2%, an improvement in efficiency of 4.2%. With smaller loads, the improvement is even greater.

The invention has a number of important features and advantages. By feeding the reflected energy back into the oven cavity, the invention provides more efficient use of the microwave energy and eliminates damage to the magnetron. This permits the magnetron to be designed for maximum efficiency, rather than ability to withstand the reflected power, and this further enhances the overall heating efficiency of the oven. In addition, the use of two feed ports provides more uniform heating throughout the oven cavity, particularly with light loads.

It is apparent from the foregoing that an improved method and apparatus for heating with microwave energy have been provided. While only certain presently preferred embodiments have been described in detail, as will apparent to those familiar with the art, certain changes and modifications can be made without departing from the scope of the invention as defined by the following claims.

What is claimed is:

1. In a method for heating material in a microwave oven, the steps of: placing the material in the cavity of the oven, supplying microwave energy to the oven cavity through a first feed port, a portion of said energy being reflected back into the port from the oven cavity, intercepting the reflected energy which enters the first feed port, and feeding the reflected energy back into the oven cavity through a second feed port.

2. In apparatus for heating material with microwave energy: means defining an oven cavity for receiving the material to be heated, a source of microwave energy positioned outside the oven cavity, first and second feed ports communication with the oven cavity, and means including a three-port circulator interconnecting the source of microwave energy and the feed ports to provide unilateral transmission of microwave energy from the source to the first feed port and from the first feed port to the second feed port and from the first feed port to the second feed port whereby microwave energy is delivered to the cavity from the source through the first feed port and microwave energy reflected from the oven cavity back into the first feed port is returned to the cavity through the second feed port.

3. The apparatus of claim 2 wherein the feed ports are isolated from each other to prevent microwave energy in the oven cavity from passing directly between the ports.

4. In a microwave oven having a magnetron for generating microwave energy and a cavity for receiving material to be heated: first and second feed ports communicating with the oven cavity, and means including a three-port circulator interconnecting the magnetron and the feed ports in such manner that microwave energy is supplied from the magnetron to the cavity through the three-port circulator and the first feed port and energy reflected from the cavity back into the first feed port is fed back into the cavity by the by the three-port circulator and the second feed port.

5. The microwave oven of claim 4 wherein the three-port circulator provides unilateral transmission between the first and second ports thereof and between the second and third ports thereof, and the means interconnecting the magnetron and the feed ports comprises a first waveguide extending between the magnetron and the first circulator port, a second waveguide extending between the second circulator port and the first feed port, and a third waveguide extending between the third circulator port and the second feed port.

* * * * *